US007466230B2

(12) United States Patent
Bergsmann et al.

(10) Patent No.: US 7,466,230 B2
(45) Date of Patent: Dec. 16, 2008

(54) DEVICE FOR THE STORAGE OF SOLID AND/OR LIQUID AND/OR GASEOUS OBJECTS

(75) Inventors: Martin Bergsmann, Leonding (AT); Adolf Bernds, Baiersdorf (DE); Wolfgang Clemens, Puschendorf (DE); Axel Gerlt, Fuerth (DE); Marcus Halik, Erlangen (DE); Matthias Müller, Bechtsrieth (DE); Henning Rost, Erlangen (DE); Günter Schmid, Hemhofen (DE); Roland Treutlein, Pirk (DE)

(73) Assignee: Hueck Folien Gesellschaft m.b.H., Baumgartenberg (AT)

( * ) Notice: Subject to any disclaimer, the term of this patent is extended or adjusted under 35 U.S.C. 154(b) by 0 days.

(21) Appl. No.: 10/566,144

(22) PCT Filed: Jul. 26, 2004

(86) PCT No.: PCT/DE2004/001668

§ 371 (c)(1),
(2), (4) Date: Dec. 5, 2006

(87) PCT Pub. No.: WO2005/011564

PCT Pub. Date: Feb. 10, 2005

(65) Prior Publication Data

US 2007/0267431 A1 Nov. 22, 2007

(30) Foreign Application Priority Data

Jul. 28, 2003 (DE) ..... 103 35 284

(51) Int. Cl.
*G04C 21/16* (2006.01)
*G04C 23/14* (2006.01)
*G08B 23/00* (2006.01)
*G08B 13/14* (2006.01)

(52) U.S. Cl. ..... 340/568.1; 340/573.1; 368/251

(58) Field of Classification Search ... 340/572.1–572.9, 340/573.1, 309.16; 368/10, 243–249, 250–260
See application file for complete search history.

(56) References Cited

U.S. PATENT DOCUMENTS 5,088,056 A * 2/1992 McIntosh et al. ..... 702/177

(Continued)

FOREIGN PATENT DOCUMENTS

CA 2272017 11/1999

(Continued)

OTHER PUBLICATIONS

International Search Report, dated Jan. 21, 2005, corresponding to PCT/DE2004/001668.

*Primary Examiner*—Jennifer Mehmood
(74) *Attorney, Agent, or Firm*—Christie, Parker & Hale, LLP.

(57) ABSTRACT

A device for the storage of at least one of solid, liquid or gaseous objects. The device including at least one compartment that is configured to contain at least one object. The filling or emptying of the compartment triggers an electrically-readable signal. In one embodiment, the compartment may be mechanically modified and an electrically-readable signal is generated based on a corresponding mechanical change to the compartment. An electrical data memory with at least one memory cell is integrated into the device. The memory cell is assigned to the compartment. The memory cell is configured to adopt a value corresponding to the mechanical change to the compartment. The device also includes an analytical circuit for reading the data memory.

25 Claims, 6 Drawing Sheets

U.S. PATENT DOCUMENTS

| | | | | |
|---|---|---|---|---|
| 5,412,372 | A * | 5/1995 | Parkhurst et al. | 340/568.1 |
| 5,508,684 | A * | 4/1996 | Becker | 340/572.5 |
| 5,862,222 | A * | 1/1999 | Gunnarsson | 705/77 |
| 6,244,462 | B1 | 6/2001 | Ehrensvard et al. | |
| 6,392,544 | B1 * | 5/2002 | Collins et al. | 340/572.7 |
| 6,696,953 | B2 * | 2/2004 | Qiu et al. | 340/572.3 |
| 6,888,502 | B2 * | 5/2005 | Beigel et al. | 343/700 MS |
| 7,158,011 | B2 * | 1/2007 | Brue | 340/309.16 |
| 2002/0067270 | A1 * | 6/2002 | Yarin et al. | 340/573.1 |
| 2003/0063524 | A1 * | 4/2003 | Niemiec et al. | 368/10 |
| 2004/0008123 | A1 * | 1/2004 | Carrender et al. | 340/825.49 |

FOREIGN PATENT DOCUMENTS

| | | | |
|---|---|---|---|
| CA | 2 353 350 | | 1/2003 |
| DE | 197 39 438 | A1 | 3/1999 |
| DE | 198 52 602 | A1 | 5/2000 |
| EP | 0 972 507 | A1 | 1/2000 |
| WO | WO 98/09042 | A1 | 10/1989 |
| WO | WO 00/07904 | A2 | 2/2000 |
| WO | WO 01/172260 | | 10/2001 |

* cited by examiner

DEVICE FOR THE STORAGE OF SOLID AND/OR LIQUID AND/OR GASEOUS OBJECTS

CROSS-REFERENCE TO A RELATED APPLICATION

This application is a National Phase Patent Application of International Application Number PCT/DE2004/001668, filed on Jul. 26, 2004, which claims priority of German Patent Application Number 103 35 284.8, filed on Jul. 28, 2003.

BACKGROUND

The invention relates to a device for the storage of solid and/or liquid and/or gaseous objects. It makes it possible in particular for the state of packs such as blister packs or food packs to be automatically registered.

It is known in the health sector to use blister packs for storing and providing dosages of medicaments. To be able to appreciate the effect of medication that is administered, including possible side-effects, and to draw conclusions from this for further treatment, it is often important for the doctor carrying out the treatment to be able to establish precisely the amount of the administered medicament that has been taken and the time at which it was taken. For this purpose, there are known readers that register the state of the blister pack and, possibly via a remote connection, transmit the corresponding information to the doctor carrying out the treatment. Such monitoring capabilities are desired in particular in the area of home care.

To register the state of blister packs, the known readers are designed such that the blister pack to be examined is introduced essentially completely into the reader. The state of the blister packs is then determined either optically or electronically. In the latter case, a simple interconnect is printed on the individual blisters, so that by applying two contacts in each case to a blister it can be detected whether or not the blister is still intact. A disadvantage here is that a large number of contacts have to be provided in the reader.

Known readers for blister packs generally have complex construction and high production costs. In addition, respective dimensions of the blister packs may need to be examined.

The problems that may occur when registering the state of blister packs may also arise when registering the state of other packs, such as, for example, medicine packs or food packs. Medicine packs or food packs may also need to be examined to ascertain whether they are intact.

The invention is based on the desire to provide a device for the storage of solid and/or liquid and/or gaseous objects which, in conjunction with a reader, makes it possible for the state of the device to be registered in a simple and low-cost manner.

SUMMARY

A solution that may be provided in embodiments of the invention is triggering an electrically readable signal when an object is placed in or removed from a compartment, thereby allowing the state of the device to be determined.

One embodiment of the invention is a device for the storage of at least one of a solid, a liquid or a gaseous object. The device has at least one compartment configured to contain at least one object. Placing the object in the compartment or removing the object from the compartment triggers an electrically readable signal. The electrically readable signal allows the state of the device to be registered. In this case, removal of an object from a compartment and also filling or loading of a compartment with an object can be determined or registered.

In one embodiment of the invention, it is provided that the compartment is mechanically changed during removal of the object and/or during filling or loading the compartment with the object.

An electrically readable signal is generated when there is a mechanical change of the compartment. The mechanical change therefore leads to the generation of an electrically readable signal.

In one embodiment, it is provided that an electrical data memory is integrated in the device. The electrical data memory has at least one memory cell assigned to a compartment of the device. The memory cell adopts a different memory value when there is a mechanical change of the compartment. In various embodiments evaluation electronics for reading from the data memory are additionally integrated in the device.

One embodiment is based on the idea of forming the device for the storage of solid and/or liquid and/or gaseous objects as a carrier of electrical functionality. In this case, a memory cell is respectively assigned to a compartment of the device that mechanically changes when an object is removed, so that the mechanical change of the compartment is reflected in a changed memory value of the respective memory cell. By the evaluation electronics reading from the memory cells, the state of the individual compartments of the device, and consequently of the device as a whole, can be registered. In one embodiment, the evaluation electronics is integrated directly in the substrate of the device. In one embodiment, the evaluation electronics is formed on a separate carrier that is applied to the device.

The integration of the evaluation electronics in the device allows for intelligence for registering a change of state of the device to be integrated in the device. This takes place in particular by the electrical data memory and the evaluation electronics being integrated in commercially available packs, in particular, by using polymer electronics. In one embodiment, realizing electronic functionalities in the device allows the intelligence of a reader to be reduced considerably and the size of a reader to be miniaturized to a size comparable to that of a display, resulting in a considerable cost saving.

In this case, the reader communicates with a standard interface of the evaluation electronics and does not necessarily provide the reader with means that register the state of all the compartments of the reader. Rather, it may be adequate just to provide a contact for serial data transmission. Furthermore, it may not be necessary for the readers to accommodate the device of which the state is to be registered. This allows the readers to be made smaller and to be used in connection with a much greater variety of packs. Altogether, in one embodiment, the automatic detection of the state of a device for the storage of solid and/or liquid and/or gaseous objects is made possible in a much simpler and low-cost way by the stated solution.

It is pointed out that, for the purposes of the present invention, a "compartment" is understood as meaning any region that can be spatially confined and allows an object to be at least partly accommodated or stored. In particular, compartments may be enclosed or only partly enclosed regions of a device. The device considered may have one or more compartments. For the purposes of the present invention, an "object" that is located in a compartment may be solid and/or liquid and/or gaseous. Objects are, by way of example but not limitation, tablets or portions of food.

In one embodiment of the invention, a compartment respectively communicates with an associated memory cell. A mechanical change of the compartment accordingly leads to a changed memory value of the memory cell. In this case the compartment may have an interconnect that is part of the memory cell. The interconnect is destroyed when there is a mechanical change of the compartment, whereby the memory cell adopts a different value.

The memory cell and the associated compartment may, however, also be coupled in some other way. In one embodiment, the compartment forms a capacitance, the capacitance changing when there is a mechanical change of the compartment, so that the memory cell then adopts a different value. It is likewise conceivable for the compartment to form an inductance and the inductance to change when there is a mechanical change of the compartment. In this case, the memory cell adopts a different memory value on the basis of the changed inductance. The memory cell may also have an oscillating circuit that is destroyed or detuned when there is a mechanical change of the compartment, which in turn leads to a different memory value. The latter cases are appropriate alternatives to the electrical registration of a mechanical change of a compartment, in particular when an alternating voltage source is integrated in the device.

It should generally be noted that it is possible to provide both embodiments of a memory cell in which the memory cell stores digital values, in particular digital voltage values (for example "ZERO" or "ONE"), and embodiments of a memory cell in which the memory cell stores analog values. In one embodiment, only two values can be stored (for example "ZERO" or "ONE"), which correspond to the two states of the compartment ("filled" and "empty" or "intact" and "opened").

In one embodiment, the evaluation electronics have, for example, a shift register for reading from the data memory. The individual memory cells of the data memory in this case form parallel inputs of the shift register. The reading from the shift register takes place serially via a suitable interface. However, the evaluation of the data memory by a shift register is only given by way of example. A person skilled in the art would know that the reading of memory values of a data memory can be realized in a variety of ways.

The solution provided by the invention includes both embodiments in which a voltage source is integrated in the device and embodiments in which a voltage source is not integrated. In the latter case, the energy for operating the data memory and the evaluation electronics is supplied externally, for instance by the reader. In the same way as the actual data transmission, this may take place with or without contacts.

In the case of a connection with contacts between the device and the reader, the evaluation electronics may have two terminal contacts for the voltage (the operating voltage Vdd and GROUND) and a terminal contact for serial data transmission. In addition, there may be a terminal contact for a timer. In the case of a contactless connection between the device and the reader, the energy is coupled in inductively or by an electromagnetic signal. The latter methods are provided in the case of information transmission on the basis of RFID (Radio Frequency Identification) and are known to a person skilled in the art.

In one embodiment of the invention, it is provided that the evaluation electronics themselves have a timer and store the time at which a compartment was mechanically changed. This makes it possible additionally to store the time of removal of a medicament or food from a compartment under consideration and establish this after the event. If corresponding intelligence is integrated in the evaluation electronics, in one embodiment, the evaluation electronics may be formed as a separate chip with an integrated voltage source that is applied to the device, for example adhesively attached. Such a "high-performance" embodiment of the evaluation electronics is expedient in particular in the case of high-value medicaments, for example genetic engineering medicaments. In one embodiment, the chip may be formed as a silicon chip.

However, the memory cell and/or the interconnects and/or component evaluation electronics may be integrated directly in the substrate of the device. The memory cell may, in one embodiment, be formed as an inherent write once read-only memory (WOROM) integrated in the substrate of the device. To this extent, a writing operation only takes place once, when a mechanical change of the compartment respectively under consideration leads on one occasion to a changed memory value of the memory cell assigned to a compartment.

In one "low performance" embodiment of the invention, the data memory and/or interconnects and/or components of the evaluation electronics are at least partly formed as elements of polymer electronics. In particular, the device has for this purpose an assembly of layers and at least one of the layers of the assembly is used for forming an electrical function. In one embodiment, active and/or passive electrical components, such as transistors, diodes, capacitors, inductors or resistors as well as circuits formed from them, are integrated in the assembly of layers. The data memory and the evaluation electronics or components of the data memory and of the evaluation electronics can in this way be integrated at low cost directly in the substrate of the device for the storage of solid and/or liquid and/or gaseous objects. The integration may take place in the substrate of the pack that represents or has the device.

The formation of electronic circuits from plastic on or in a commercially available packaging film may be known. In a way similar to newspaper printing, the film runs through a number of coating and structuring operations. Active or passive electronic components are thereby integrated in the individual layers of the film, so that electronic circuits can be formed in the film.

The materials necessary for realizing electronic circuits, that is to say semiconductors, insulators and interconnects, are respectively available as polymers or as low molecular weight compounds of an organic, inorganic or organometallic nature and as composites (organic, inorganic, organic/inorganic), so that the materials can be applied one after the other to different carrier materials in order to realize a desired electronic functionality. In particular, it is also possible to provide organic transistors, which, in a way similar to silicon-based transistors, are made up of a number of layers: substrate, gate electrode, gate insulator, source and drain contacts, organic semiconductors (for example pentazene or substituted oligothiophenes) and a protective passivation. It is also conceivable for hybrid organic/inorganic structures to be used and integrated in the substrate of the device or the substrate of the pack.

The integration of electrical functionality in plastic films based on polymer electronics represents an extremely appropriate embodiment of the teaching to integrate evaluation electronics for reading from a data memory together with the data memory in a device for the storage of solid and/or liquid and/or gaseous objects. However, it is only one embodiment. In principle, the data memory and the evaluation electronics may also be realized in some other way, as stated above.

In on embodiment, in the event that the substrate of the device has an aluminium layer, the electrical lines of the data memory or the evaluation electronics are formed by the aluminium layer itself, which for this purpose is correspondingly structured and after the structuring serves as an interconnect level. In one embodiment, the interconnects may, for example, be realized with the aid of conducting organic compounds by being printed on. The organic compounds may be, for example, carbon black, polystyrene sulfonic acid doped polyethylene dioxythiophene (PEDOT:PSS) or camphor sulfonic acid doped polyaniline.

It has already been pointed out that the device may represent or have a pack, the pack forming the compartments, and the data memory and the evaluation electronics being integrated in the substrate of the pack. In one embodiment, the pack is, for example, a blister pack. However, the invention is also suitable for detecting the state of other packs, in particular for detecting the state of food packs. For example, the device may be a yogurt cup. Together with the aluminium lid, the yogurt cup in this case forms a memory cell, the memory value of the memory cell being changed when the conducting aluminium lid is pulled off, i.e. when there is a mechanical change of the yogurt cup. In one embodiment, the evaluation electronics are, for example, integrated in the plastic material of the cup.

BRIEF DESCRIPTION OF THE DRAWINGS

The invention is explained in more detail below on the basis of several exemplary embodiments with reference to the figures of the drawing.

DETAILED DESCRIPTION

Figure 1:
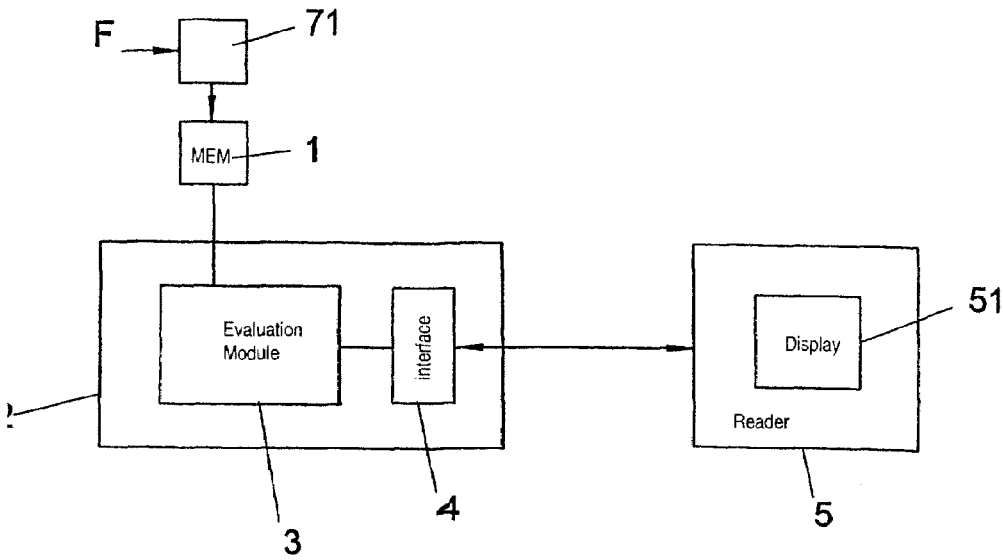
FIG. 1 shows a schematic view of a data memory and evaluation electronics of a device for the storage of solid and/or liquid and/or gaseous objects and also an associated reader.

FIG. 1 shows a data memory 1 and evaluation electronics 2 that form a component part of a device for the storage of solid and/or liquid and/or gaseous objects.

The data memory 1 has a memory cell that is assigned to a compartment 71 of the device for the storage of solid and/or liquid and/or gaseous objects. The compartment 71 is configured to contain at least one object. For example, in one embodiment, the compartment 71 is a blister of a blister pack. When a mechanical force is exerted on the compartment for the purpose of removing the object contained therein, the compartment 71 is mechanically deformed or changed. This change leads to a changed memory value in the memory cell. For example, in one embodiment, the memory value before removal of the object is logical zero and after removal of the object is logical one.

The evaluation electronics 2 are provided for reading the memory value from the data memory 1. The evaluation electronics 2 have an evaluation module 3 and an interface 4. The values of the data memory 1 registered by the evaluation module 3 can be transmitted via the interface 4 to an external reader 5. The transmission may take place with or without contacts. In one embodiment, the reader 5 has a display 51 on which the information concerning the memory value of the data memory 1 or the corresponding information on the state of the device under consideration can be displayed. Since the evaluation electronics 2 are integrated in the device for the storage of solid and/or liquid and/or gaseous objects, the reader 5 can be designed in a simple manner.

Figure 2:
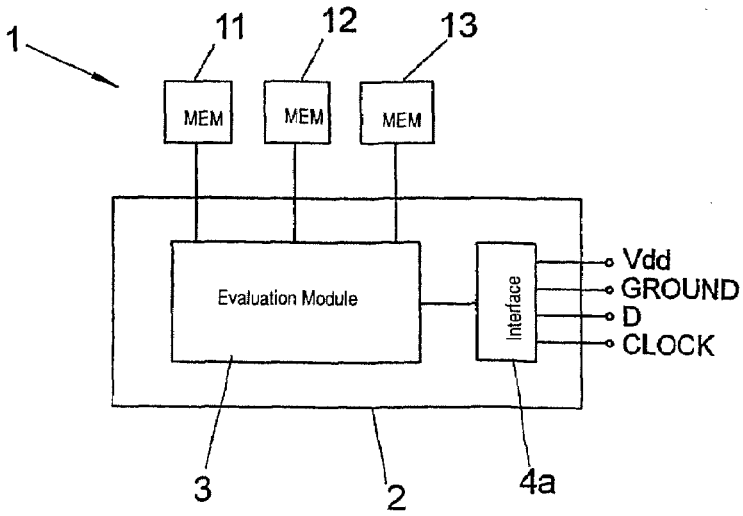
FIG. 2 shows one embodiment of the evaluation electronics of FIG. 1, in which the interface of the evaluation electronics is formed as an interface with contacts.

FIG. 2 shows an embodiment of the device for the storage of solid and/or liquid and/or gaseous objects in which a data transmission to a reader takes place with contacts. In the embodiment of FIG. 2, data memory 1 contains three memory cells 11, 12, 13, which are respectively assigned to a corresponding compartment (not separately represented). The evaluation module 3 reads the current values from the memory cells 11, 12, 13 and communicates this information to the interface 4*a*. In one embodiment, the interface 4*a* has four standardized terminals. These terminals are a terminal for the operating voltage Vdd, a terminal for the reference potential GROUND, a terminal D for serial data transmission and a terminal for a clock. It is also possible to dispense with the latter. With the clock, the data transmission is synchronous, without the clock it is asynchronous.

Figure 3:
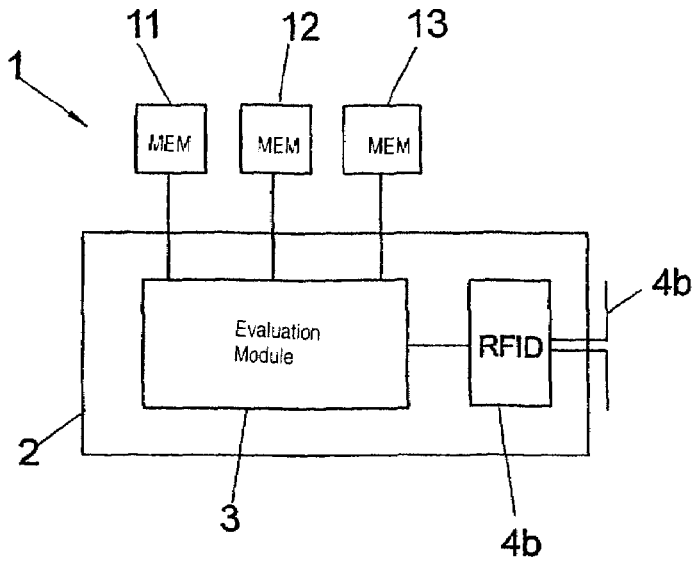
FIG. 3 shows one embodiment of the evaluation electronics of FIG. 1, in which the interface of the evaluation electronics is formed as an RFID interface.

As shown in FIG. 3, in one embodiment of a data memory 1, a contactless interface 4*b* may be configured to operate according to the Radio Frequency Identification (RFID) standard. The RFID interface 4*b* represents a transceiver (or a "tag"), which interacts with an RFID reader. For contactless communication, the RFID interface 4*b* has an antenna 4*b*. Energy is coupled into the interface 4*b* inductively or by electromagnetic waves via the reader and is made available to an evaluation unit 2 and a data memory 1. With the aid of the energy coupled into the interface 4*b*, the current value of the memory cells 11, 12, 13 is registered and transmitted to the reader.

RFID interfaces may in this case be formed in a variety of ways. For example, it may also be provided that a voltage source is integrated in the RFID interface 4*b* or in the evaluation electronics 2 (what is known as an active RFID transceiver). Contactless communication by RFID components is well-known to those skilled in the art.

Figure 4:
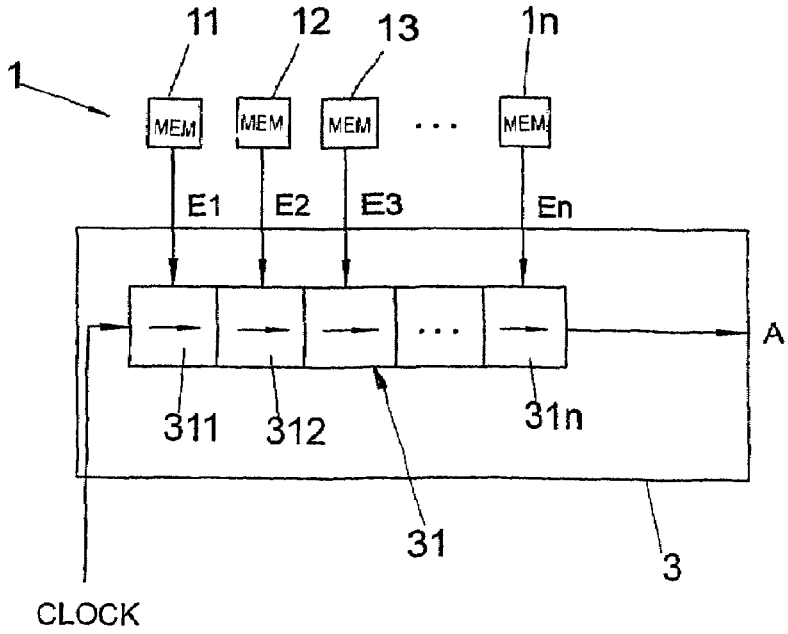
FIG. 4 shows one embodiment of the evaluation electronics of FIGS. 1, 2 and 3, in which the evaluation electronics have a shift register.

FIG. 4 shows one embodiment of an evaluation module 3. In the embodiment represented, the evaluation module 3 has a shift register 31 with a plurality of cells 311, . . . 31*n*. The output values of a plurality of memory cells 11, 12, 13 . . . 1n are input via parallel inputs E1, E2, E3, . . . En to the individual cells 311, . . . 31n of the shift register 31. The shift register 31 passes the information of the respective cell on to the next cell at clock intervals. At the output A, the information of the individual data memories can be read in a serial mode.

The clock of the shift register 31 is prescribed by a timer CLOCK. It is possible for a timing signal supplied by the timer CLOCK to be externally supplied or for the timer CLOCK to be integrated in the evaluation electronics.

Figure 5:
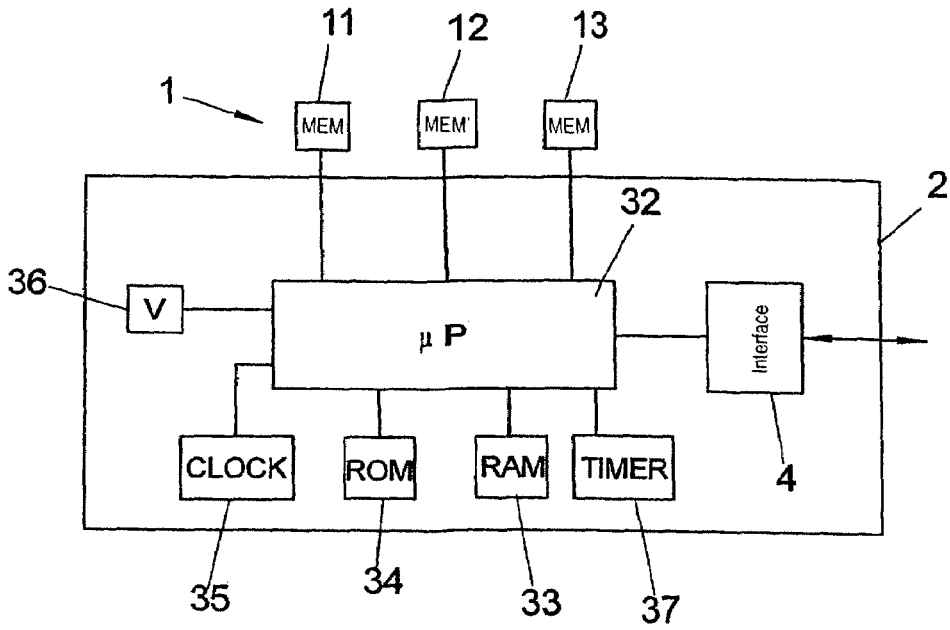
FIG. 5 shows one embodiment of the evaluation electronics of FIGS. 1, 2, 3 and 4, in which the evaluation electronics are formed as a separate chip with an integrated timer function and voltage supply.

FIG. 5 shows one embodiment of evaluation electronics 2 that are formed in a separate chip, which is applied to the device for the storage of solid and/or liquid and/or gaseous objects and is electrically connected to the data memory 1 of the device via suitable contacting points (not shown). In one embodiment, the evaluation electronics 2 are formed, for example, on a silicon chip. A microprocessor 32 with RAM and ROM devices 33, 34 and also a clock generator 35, a timer device 37 and a voltage supply device 36 are provided. By providing a timer device 37, it is also possible to store the time at which a compartment or the memory value of the associated memory cell 11, 12, 13 changes. The function of a timepiece is therefore provided. When monitoring the state of the device, it is therefore possible also to register the time of removal of the respective object, such as for instance a tablet of a blister pack.

Figure 6A:
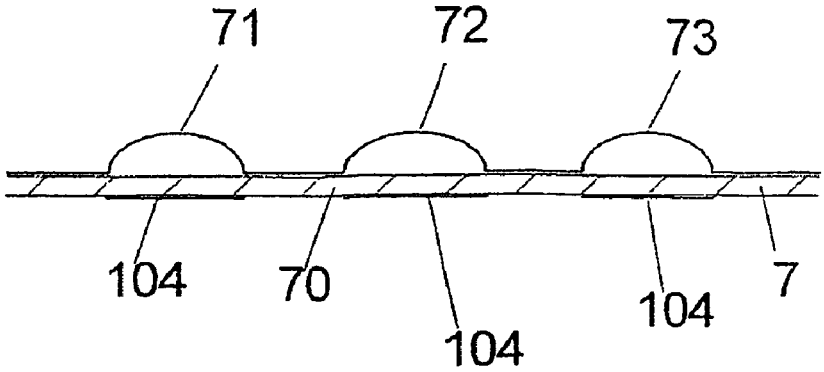
FIG. 6*a* shows in side view a number of blisters of a blister pack, wherein the blisters are each assigned to a memory cell.
Figure 6B:
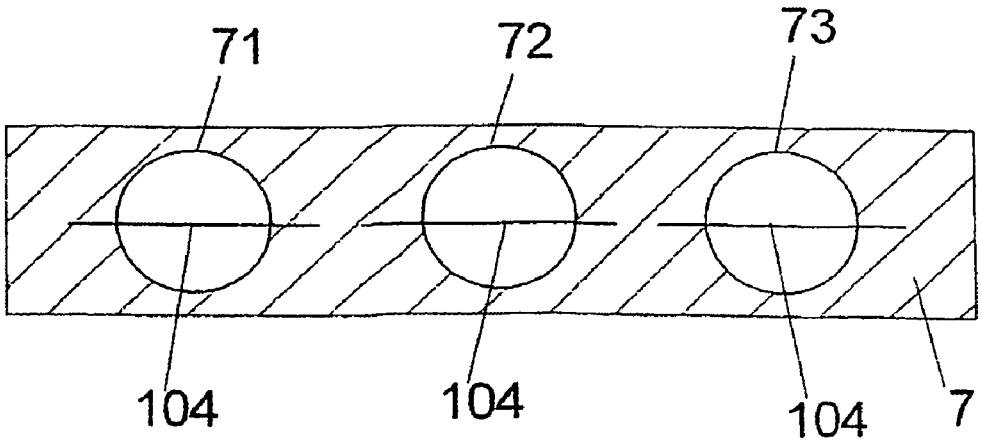
FIG. 6*b* shows a plan view of the blister pack of FIG. 6*a*.

FIGS. 6A and 6B show a blister pack 7 with a plurality of blisters 71, 72, 73 in side view and in plan view, respectively, as an example of a device for the storage of solid and/or liquid and/or gaseous objects. Each blister 71, 72, 73 is assigned to a memory cell. In this embodiment, an interconnect 104 is respectively integrated in the region 70 of the blister that can be pressed in. This interconnect is destroyed when the blister is pressed through. This leads to writing of the memory cell assigned to the respective blister 71, 72, 73, or to a change of the memory value.

Figure 7:
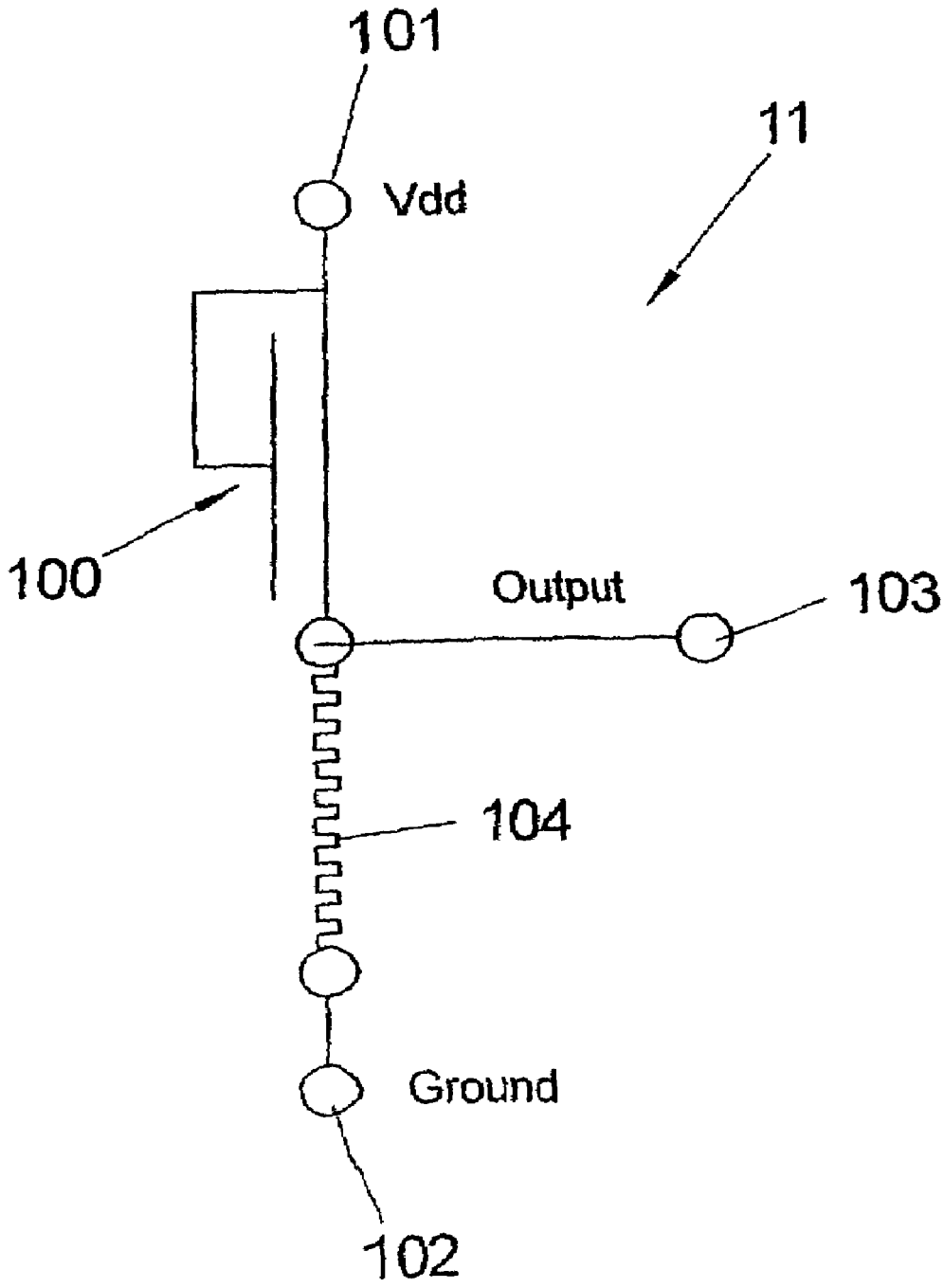
FIG. 7 shows one embodiment of a memory cell.

FIG. 7 shows one embodiment of a memory cell 11. According to the embodiment of FIG. 7, a line that is partly formed by the interconnect 104 of the compartment is coupled between the Ground terminal 102 and the operating voltage Vdd terminal 101. An output signal is provided at an output 103. A p-channel transistor 100 that is realized with polymer electronics, in one embodiment, limits the current, so when the interconnect 104 is closed, the potential at the output 103 is zero volts (logical zero). When the interconnect 104 is destroyed, the operating voltage Vdd (logical one) is present at the output 103.

The embodiment of the memory cell represented in FIG. 7 is to be understood as given merely by way of example. Numerous other embodiments of a memory cell are possible, and all such embodiments are within the scope of the invention. For example, in one embodiment, instead of a current-limiting transistor, a resistor may also be provided. In one embodiment, for alternating current applications, capacitors and/or inductors may be used.

Figure 8:
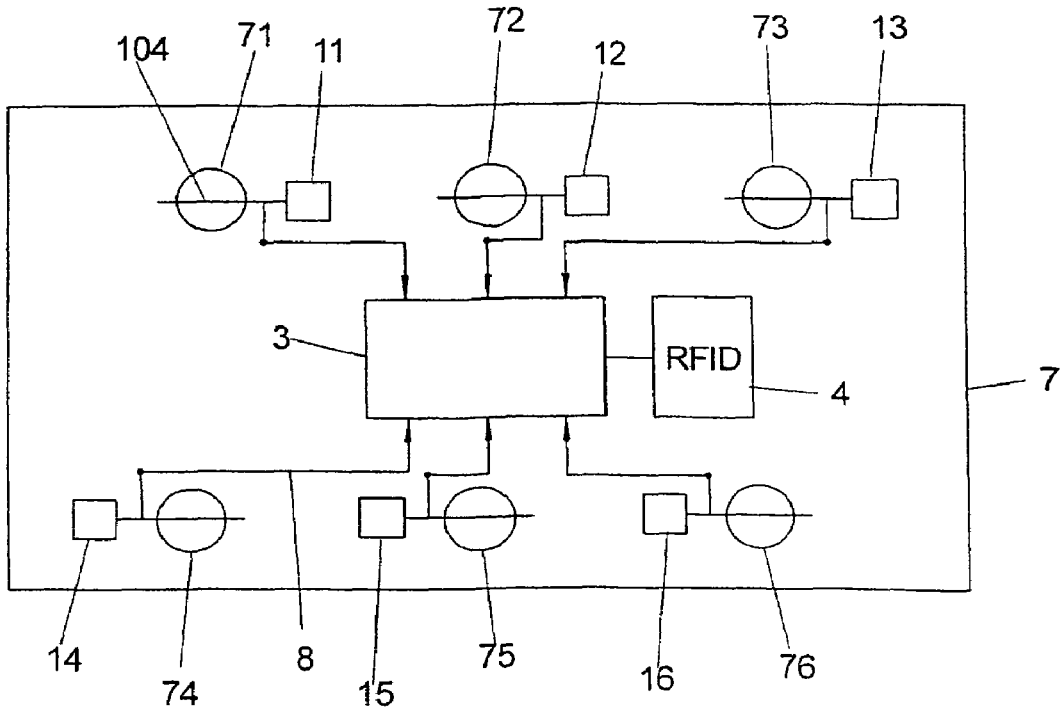
FIG. 8 shows a blister pack with integrated memory cells and integrated evaluation electronics.

FIG. 8 shows a memory cell with six blisters 71, 72, 73, 74, 75, 76 and six respectively assigned memory cells 11, 12, 13, 14, 15, 16, which are formed in one embodiment as described with reference to FIG. 7. The outputs of the memory cells are connected via electrical lines 8 to an evaluation module 3''' that reads the content from the memory cells 71, 72, 73, 74, 75, 76 and passes the data on to an interface 4 for transmission to a reader. In one embodiment, the information transmission takes place without contacts by an RFID interface.

Referring to FIG. 8, in one embodiment, the memory cells and also the evaluation module 3 and the RFID module 4 are configured at least partly by polymer electronics. In this embodiment, the carrier 8 for the electrical lines 104 is a correspondingly structured aluminium layer of the blister pack, which, after structuring, contains interconnects. In this embodiment, the other components of the memory cells and of the evaluation electronics, such as transistors and diodes, are integrated in additional layers of the plastic material of a blister pack 7. In this embodiment, the RFID interface 4 is also realized through the use of polymers.

Instead of an RFID interface 4, an interface with contacts, corresponding to the interface 4*a* of FIG. 2, may also be used.

With reference to FIGS. 1 and 8, after removal of the medicament contained in the respective blisters 71, 72, 73, 74, 75, 76, the information on the change of the respective blister is read into the reading module 5 and presented there or passed on. The reading module may, in this embodiment, be used with a plurality of blister packs of different sizes and numbers of blisters. Commercially available RFID readers or readers specially designed for blister packs may be used.

The invention is not restricted in its implementation to the embodiments presented above. Instead of blister packs, any other desired packs or devices for the storage of solid and/or liquid and/or gaseous objects may be used in connection with the invention. In one embodiment, the compartments that can change mechanically when an object is removed are, for example, compartments of commercially available food packs. The invention may then make it possible after a delivery of food has been received to determine whether a pack of individual food has been damaged during transit.

In other embodiments of the invention, the filling of a compartment is registered, and an electrically readable signal is generated when a compartment is filled. The electrically readable signal is triggered in particular by a mechanical change of the compartment during the filling operation.

The invention claimed is:

1. A device for storing of at least one of a solid, a liquid or a gaseous object, the device comprising:

at least one compartment configured to contain at least one object;

an electrical data memory including at least one memory cell having electronic components, the memory cell being assigned to the compartment;

wherein one of placing the object in the compartment or removing the object from the compartment triggers an electrically readable signal;

wherein the compartment is mechanically changeable for removal of the object from the compartment or placing the object in the compartment;

wherein the electrically readable signal is generated after a mechanical change of the compartment;

wherein the memory cell adopts a memory value after the mechanical change of the compartment; and wherein the compartment forms an integral part of the electronic components of the memory cell.

2. The device as claimed in claim 1, wherein the device further comprises evaluation electronics for reading the memory value from the electrical data memory.

3. The device as claimed in claim 1, wherein the compartment includes an interconnect, the interconnect being part of the memory cell, and being configured to be substantially destroyed after the mechanical change of the compartment.

4. The device as claimed in claim 1, wherein the compartment forms a capacitance, the capacitance being substantially changed after the mechanical change of the compartment.

5. The device as claimed in claim 1, wherein the compartment forms an inductance, the inductance being substantially changed after the mechanical change of the compartment.

6. The device as claimed in claim 2, wherein the evaluation electronics comprise a shift register for reading the memory value from the electrical data memory.

7. The device as claimed in claim 2, wherein the evaluation electronics comprise a terminal contact for voltage and a terminal contact for serial data transmission.

8. The device as claimed in claim 2, further comprising:

an interface of the evaluation electronics, the interface having one or more contacts for providing data transmission; and an external reader configured to provide data transmission through the one or more contacts of the interface.

9. The device as claimed in claim 2, wherein the evaluation electronics comprise a timer configured to generate information indicative of the time at which the compartment is mechanically changed.

10. The device as claimed in claim 1, wherein at least one of the memory cell or the evaluation electronics are integrated in a substrate of the device.

11. The device as claimed in claim 10, wherein the electrical data memory is a write once read only memory integrated in the substrate.

12. The device as claimed in claim 10, wherein at least one of the data memory, the interconnect or the evaluation electronics are at least partly formed as-polymer electronics.

13. The device as claimed in claim 10, wherein the device includes an assembly of layers, at least one of the layers of the assembly of layers being configured to be used for forming an electrical function.

14. The device as claimed in claim 13, wherein at least one of active electrical components or passive electrical components are integrated in the assembly of layers.

15. The device as claimed in claim 10, wherein the substrate includes an aluminum layer the aluminum layer including the interconnect.

16. The device as claimed in claim 10, wherein the substrate includes printed-on organic compounds for realization of the interconnect.

17. The device as claimed in claim 10, wherein the device is a pack, the pack having one or more compartments formed therein, and having the data memory and the evaluation electronics integrated in a substrate of the pack.

18. The device as claimed in claim 17, wherein the substrate of the pack is configured to be a carrier for at least one of the interconnect or the evaluation electronics.

19. The device as claimed in claim 17, wherein the evaluation electronics are integrated in a chip having an integrated voltage source, the chip being attached to the pack.

20. The device as claimed in claim 1, wherein the device is a blister pack.

21. The device as claimed in claim 20, wherein the blister pack includes one or more blisters, each of the one or more blisters being configured to communicate with a memory cell.

22. The device as claimed in claim 2, further comprising:

an interface of the evaluation electronics, the interface being configured to provide data transmission; and an external reader configured to provide data transmission with the interface.

23. The device as claimed in claim 2, further comprising the evaluation electronics being configured to store the time at which the compartment is mechanically changed.

24. The device as claimed in claim 14, wherein the active electrical components includes at least one of one or more transistors or circuits formed from the one or more transistors, and wherein the passive electrical components includes at least one of one or more diodes, capacitors, inductors or resistors or circuits formed from the one or more diodes, capacitors, inductors or resistors.

25. The device as claimed in claim 3, wherein the interconnect is integrated in a substrate of the device.

* * * * *